US010463167B2

(12) United States Patent
Rabbany et al.

(10) Patent No.: US 10,463,167 B2
(45) Date of Patent: Nov. 5, 2019

(54) BED BUG MATTRESS COVER

(71) Applicants: Farhad Rabbany, Beverly Hills, CA (US); Faramarz Yadegari, Beverly Hills, CA (US)

(72) Inventors: Farhad Rabbany, Beverly Hills, CA (US); Faramarz Yadegari, Beverly Hills, CA (US)

( * ) Notice: Subject to any disclaimer, the term of this patent is extended or adjusted under 35 U.S.C. 154(b) by 0 days.

(21) Appl. No.: 15/640,228

(22) Filed: Jun. 30, 2017

(65) Prior Publication Data

US 2019/0000240 A1 Jan. 3, 2019

(51) Int. Cl.

| | |
|---|---|
| ***A47C 31/00*** | (2006.01) |
| ***A47C 31/10*** | (2006.01) |
| *A47G 9/00* | (2006.01) |
| *A47G 9/04* | (2006.01) |

(52) U.S. Cl.

CPC ..... *A47C 31/105* (2013.01); *A47C 31/007* (2013.01); *A47G 9/04* (2013.01); *A47G 2009/001* (2013.01)

(58) Field of Classification Search

CPC ..... A47C 31/007; A47G 9/0238; A47G 9/04; A47G 2009/001; A44B 19/265; A44B 19/32; A44B 19/30; A44B 19/34; A44B 19/00

See application file for complete search history.

(56) References Cited

U.S. PATENT DOCUMENTS

| | | | | | |
|---|---|---|---|---|---|
| 2,422,249 | A * | 6/1947 | Malluk | A43B 3/02 | 24/389 |
| 3,008,152 | A * | 11/1961 | Seidenberg | A47G 9/0261 | 5/501 |
| 3,292,748 | A * | 12/1966 | Rifkin | A45C 3/00 | 190/119 |
| 3,310,889 | A * | 3/1967 | Samuels | A43B 5/02 | 36/72 R |
| 4,164,797 | A * | 8/1979 | Golembeck | A44B 19/34 | 24/432 |
| 4,333,248 | A * | 6/1982 | Samuels | A43B 3/18 | 36/101 |
| 5,491,853 | A * | 2/1996 | Turnbull | A47G 9/0246 | 5/497 |
| 5,745,940 | A * | 5/1998 | Roberts | A47C 27/001 | 5/727 |

(Continued)

*Primary Examiner* — Nicholas F Polito
*Assistant Examiner* — Morgan J McClure
(74) *Attorney, Agent, or Firm* — Fulwider Patton LLP

(57) ABSTRACT

A bed bug protective encasement for a mattress comprising a cover having an elongated opening with a first end and a second end formed therein, the elongated opening being adaptable to receive the mattress within the cover. A primary zipper is disposed along the elongated opening and having a slider movable from the first end to the second end to close the elongated opening. A flap attached to the cover adjacent the second end of the elongated opening is foldable over the second end of the elongated opening, the primary zipper extending onto the flap and terminating near a distal end of the flap. A secondary zipper system has a first zipper attached to a side of the flap and a second zipper attached to an opposite side of the flap, to secure the flap when the flap is folded over the second end of the elongated opening.

3 Claims, 6 Drawing Sheets

(56) References Cited

U.S. PATENT DOCUMENTS 5,896,605 A * 4/1999 Branman ..... A47C 21/00 5/716
5,910,081 A * 6/1999 Graham ..... A47C 31/105 5/699
6,446,577 B1 * 9/2002 Salahor ..... A01K 1/0254 119/470
6,634,042 B2 * 10/2003 Blossman ..... A47C 31/105 5/482
6,948,207 B2 * 9/2005 Daly ..... A47C 31/007 5/699
7,552,489 B2 * 6/2009 Bell ..... A47C 31/007 24/389
D615,795 S * 5/2010 Timmany ..... D6/606
8,087,111 B2 1/2012 Paris
D673,414 S * 1/2013 Sanders ..... D6/606
8,347,430 B2 * 1/2013 Malouf ..... A47C 31/007 5/484
8,413,276 B2 4/2013 Rattner et al.
8,516,633 B2 * 8/2013 Dobin ..... A47C 31/007 24/387
8,528,134 B2 9/2013 Bell et al.
8,615,826 B2 12/2013 Michael
8,806,678 B2 * 8/2014 Michael ..... A47C 31/007 5/482
8,938,824 B2 * 1/2015 Rensink ..... A47C 31/105 5/482
9,179,783 B2 * 11/2015 Snell ..... A47C 31/007
9,545,158 B2 * 1/2017 Goldberg ..... A47C 31/007
2005/0040559 A1 * 2/2005 Yang ..... A44B 19/36 264/275
2010/0108731 A1 * 5/2010 Rowe ..... A45F 3/042 224/654
2011/0099714 A1 * 5/2011 Svoboda ..... A47C 31/105 5/499
2011/0162140 A1 * 7/2011 Paris ..... A47C 31/105 5/499
2012/0084918 A1 * 4/2012 Rattner ..... A47C 31/105 5/500
2012/0102646 A1 * 5/2012 Chen ..... A44B 19/22 5/499
2012/0117728 A1 * 5/2012 O'Neill ..... A47C 31/007 5/499
2012/0167307 A1 * 7/2012 Michael ..... A47C 31/105 5/501
2012/0186016 A1 * 7/2012 Martin ..... A47C 31/11 5/490
2013/0133129 A1 * 5/2013 Martin ..... A44B 19/32 2/455
2013/0185841 A1 * 7/2013 Berkowitz ..... A44B 19/301 2/69
2015/0096122 A1 * 4/2015 Rabbany ..... A47C 31/007 5/490
2015/0289614 A1 * 10/2015 Fraser ..... A45C 3/004 206/292
2016/0309928 A1 * 10/2016 Lukin, Jr. ..... A47G 9/0253

* cited by examiner

BED BUG MATTRESS COVER

BACKGROUND

This invention relates to an apparatus and method for preventing bed bugs from entering into and escaping out of a bed mattress. More particularly, the invention relates to a zipper closure for a mattress encasement which, while allowing insertion and removal of the mattress, prevents the entry or escapement of bed bugs past the encasement.

Bed bugs are a type of insect that commonly hides within bed mattresses. Such bed bugs are found in motels, hostels or boarding houses where itinerant travelers find overnight lodging. Bed bugs will feed off of the blood of humans sleeping on the mattresses that harbor these insects. Typically, a bed bug will crawl out of the mattress during the night, bite the sleeping victim, and then return to the safe confines of the mattress.

To prevent the entry or escapement of bed bugs from the mattress, and thus contain and starve the bugs, techniques have been devised in which the mattress is surrounded with a fabric cover or encasement. The encasement is slipped onto the mattress and closed via a fastening mechanism such as a zipper. Bugs escaping from the mattress, or trying to enter the mattress, will encounter the barrier of the fabric cover, and thus will be prevented from entering the mattress or escaping from the mattress to reach a human sleeping on the bed.

Problems exist, however, with the use of such protective mattress covers or encasements. For example, a user may fail to completely close the zipper on the encasement, or the zipper may become partially unzipped through movement or rustling of the mattress, as for example, when the bed is made and remade. This results in an opening at the zipper end stop through which bed bugs may enter or escape. Indeed, even zippers that have been carefully and completely closed may still leave a narrow opening at the end of the zipper that is a large enough for a small bed bug to crawl through.

Accordingly, there exists a need to prevent the entry or escapement of bed bugs from a zipper opening in a mattress protective encasement and to prevent bed bugs from entering or leaving the mattress through the same opening.

SUMMARY OF THE INVENTION

In one embodiment, the invention is a bed bug protective encasement for a mattress. The encasement comprises a cover having an elongated opening with a first end and a second end formed therein, the elongated opening being adaptable to receive the mattress within the cover. A primary zipper is disposed along the elongated opening and has a slider movable from the first end to the second end to close the elongated opening. A flap is attached to the cover adjacent the second end of the elongated opening and being foldable over the second end of the elongated opening, the primary zipper extending onto the flap and terminating near a distal end of the flap. A secondary zipper system, comprising a first zipper is attached to a side of the flap, and a second zipper is attached to an opposite side of the flap to secure the flap when the flap is folded over the second end of the elongated opening. The first zipper extends at an angle between 30 degrees and 60 degrees above a longitudinal axis of the primary zipper, and the second zipper extends at an angle between 30 degrees and 60 degrees below the longitudinal axis of the primary zipper.

In some embodiments, the flap may have a triangular shape. In other embodiments, the cover comprises a vertical sidewall formed by a left sheet and a right sheet, the left sheet having a first distal end, and the right sheet having a second distal end, the first distal end overlapping the second distal end for a certain distance. The flap may comprise at least one layer, the at least one layer having a third distal end. The third distal end may be positioned between the first distal end and the second end, and wherein the first distal end, the second distal end, and the third distal end are all stitched together by a seam and disposed between the vertical sidewall and the mattress.

These and other advantages will appear from the foregoing when read with the detailed description of the drawings, and the detailed description of some embodiments.

DETAILED DESCRIPTION OF SOME EMBODIMENTS

With reference to the figures, an embodiment of the invention is described.

Figure 1:
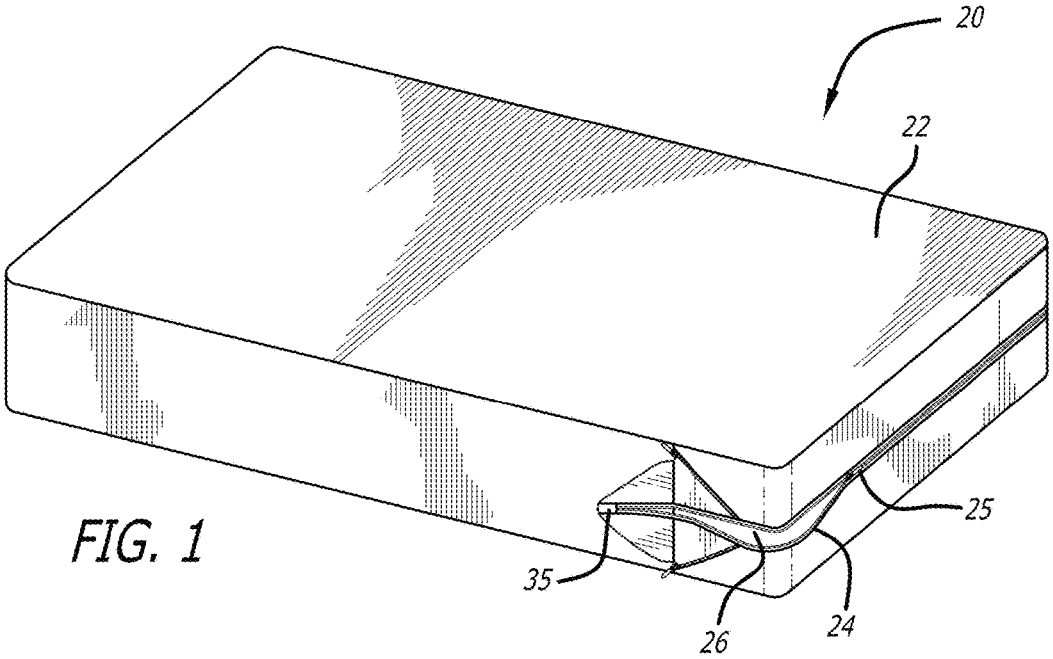
FIG. 1 is a perspective view of a mattress covered by an encasement having features of the present invention.

FIG. 1 shows a mattress 20 which has been covered in a fabric cover or encasement 22 formed of a bed bug impervious material. A primary zipper 24 having a slider 25 and cooperating zipper teeth 24', 24" (FIG. 2) surrounds the edges of an opening 26 through which the mattress 20 may be inserted or removed. The slider 25 joins or separates the teeth when the zipper is opened or closed.

Figure 2:
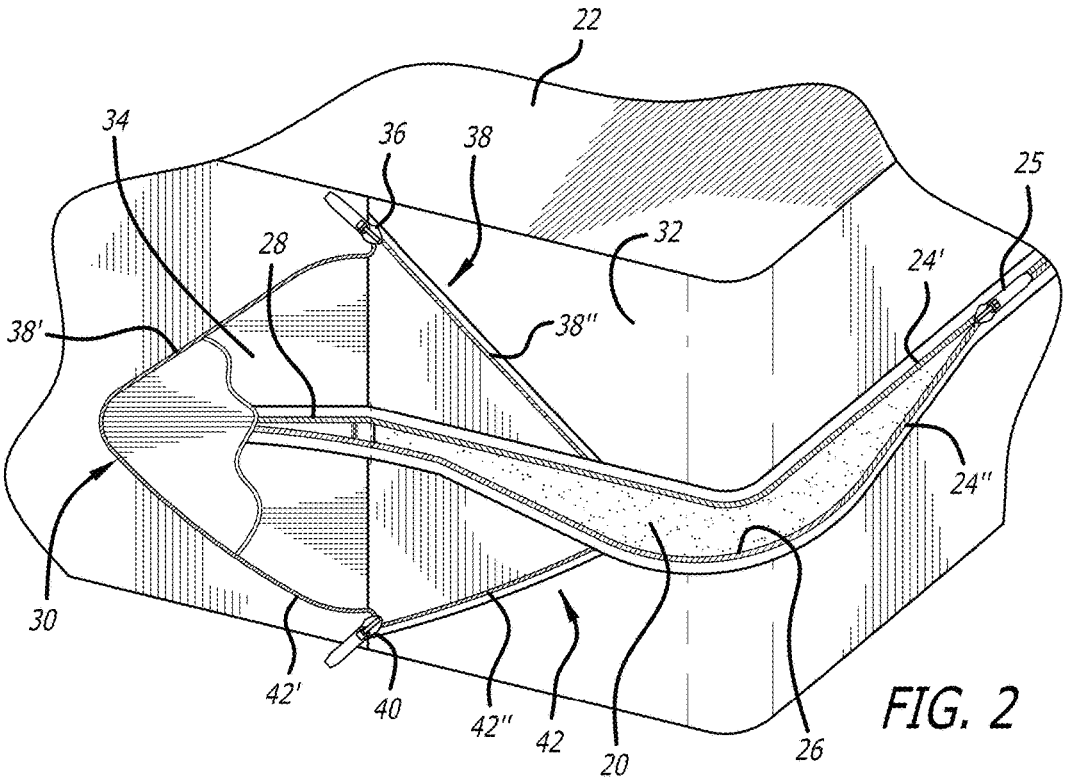
FIG. 2 is an enlarged, fragmentary, detail view of a corner portion of the encasement shown in FIG. 1, showing the encasement in a partially unzipped condition.
Figure 3:
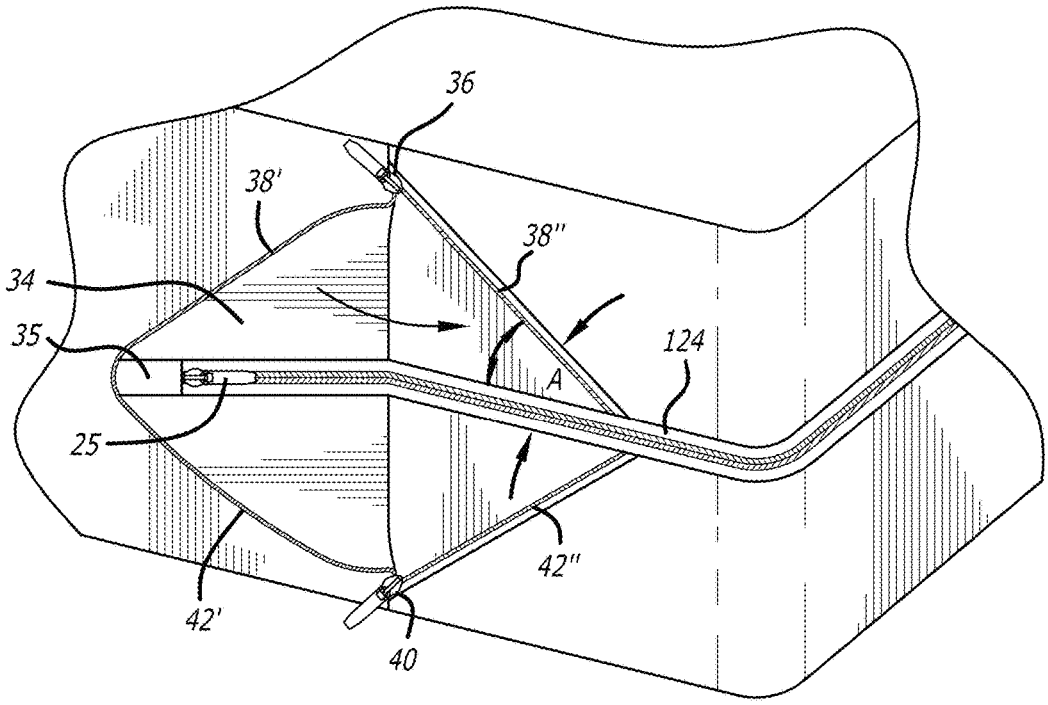
FIG. 3 is a detail view of the corner portion of the encasement shown in FIG. 2, shown in a zipped condition, but with the flap in an open condition.

FIG. 2 shows a detail of the encasement 22 shown in FIG. 1. A flap 30 is connected to a vertical side 32 of the encasement in a manner that will be described in more detail below. The flap 30 is preferably formed of the same material as the mattress cover 22 and lies outside the mattress cover. The distal end 28 of the primary zipper 24 extends onto an inner surface 34 of the flap 30, with the zipper end stop 35 (the area where the slider 25 comes to its final resting position when fully closed) located near the end of the flap 30 remote from where the flap is connected to the vertical side 32 (FIG. 3). One set of teeth 38' for an upper secondary zipper 38 is attached to and extends along an upper perimeter of the flap 30, while the corresponding set of teeth 38" of the upper secondary zipper 38 is attached to and extends along the vertical side 32 of the encasement. One set of teeth 42' of a lower secondary zipper 42 is attached to and extends along a lower perimeter of the flap 30, while the corresponding set of teeth 42" of the lower secondary zipper 42 is attached to and extends along a lower portion of the vertical side 32 of the encasement. Both secondary zippers 38 and 42 extend from the base of the flap 30 to near the top or end of the flap 30, which is preferably triangular in shape.

Figure 4:
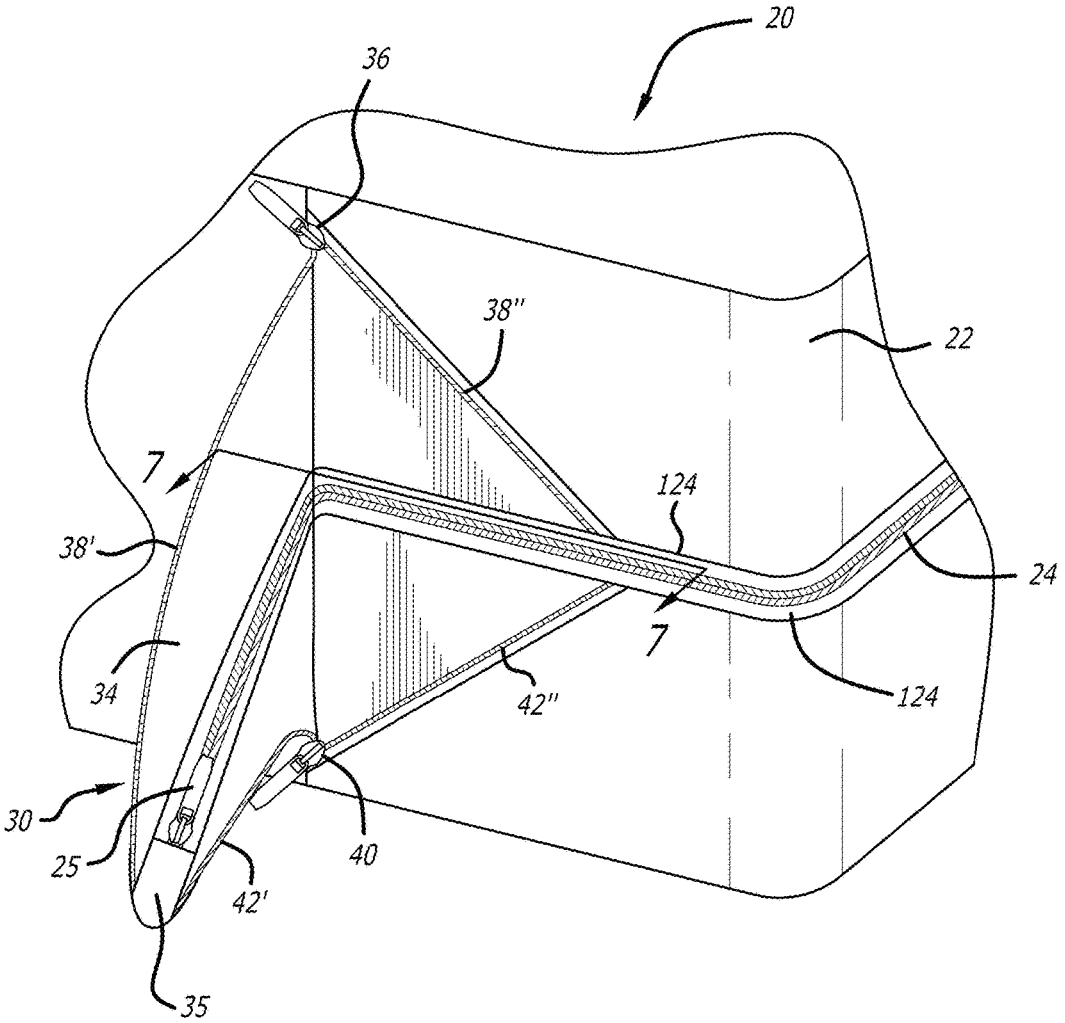
FIG. 4 is a view of the corner portion shown in FIG. 3, with the flap shown in a partially closed condition.

FIG. 4 shows the flap 30 partially folded towards the vertical side 32 of the encasement 22 once the primary zipper slider 25 is drawn to the limit of its distal travel at the end stop 35. Notably, even when the primary zipper slider 25 has been drawn to its most distal point, a small gap may remain near the end stop 35 that may not be completely closed. The flap 30 provides additional structure which covers this gap and creates an effective barrier against movement of bed bugs into and out of the mattress cover 22 through this gap. It also acts to protect and insulate the distal end of the zipper 24 from some of the movement or rustling of the mattress or other forces which might otherwise dislodge the slider 25 and create an unwanted opening at the end stop 35.

Figure 5:
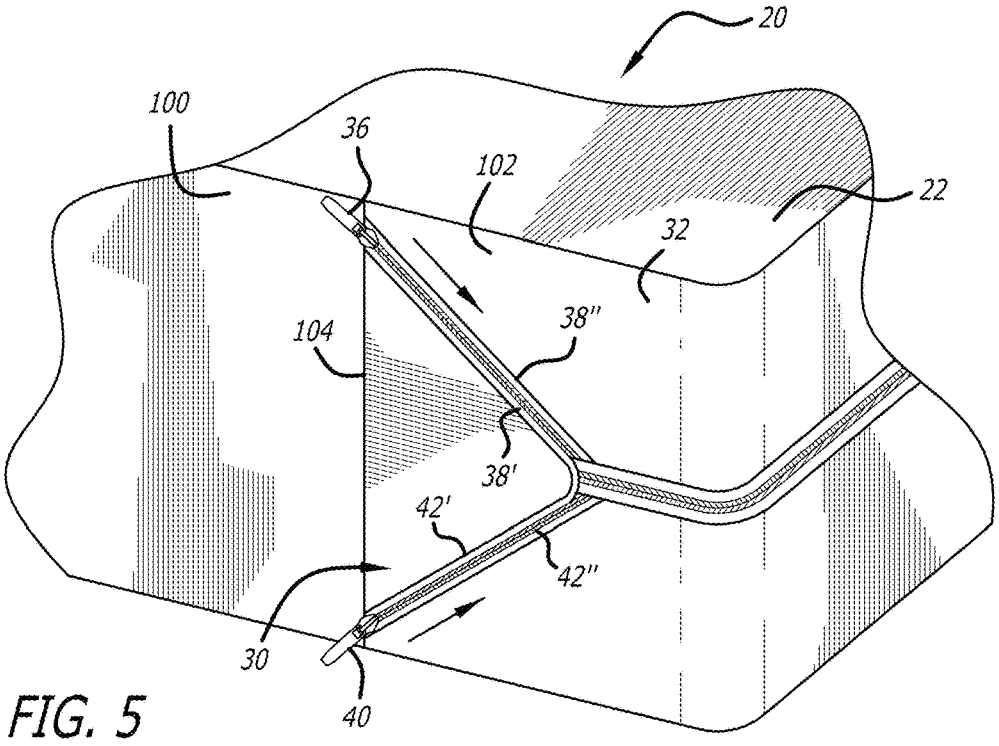
FIG. 5 is a view of the corner portion shown in FIG. 4, with the flap shown in a closed but unzipped condition.
Figure 6:
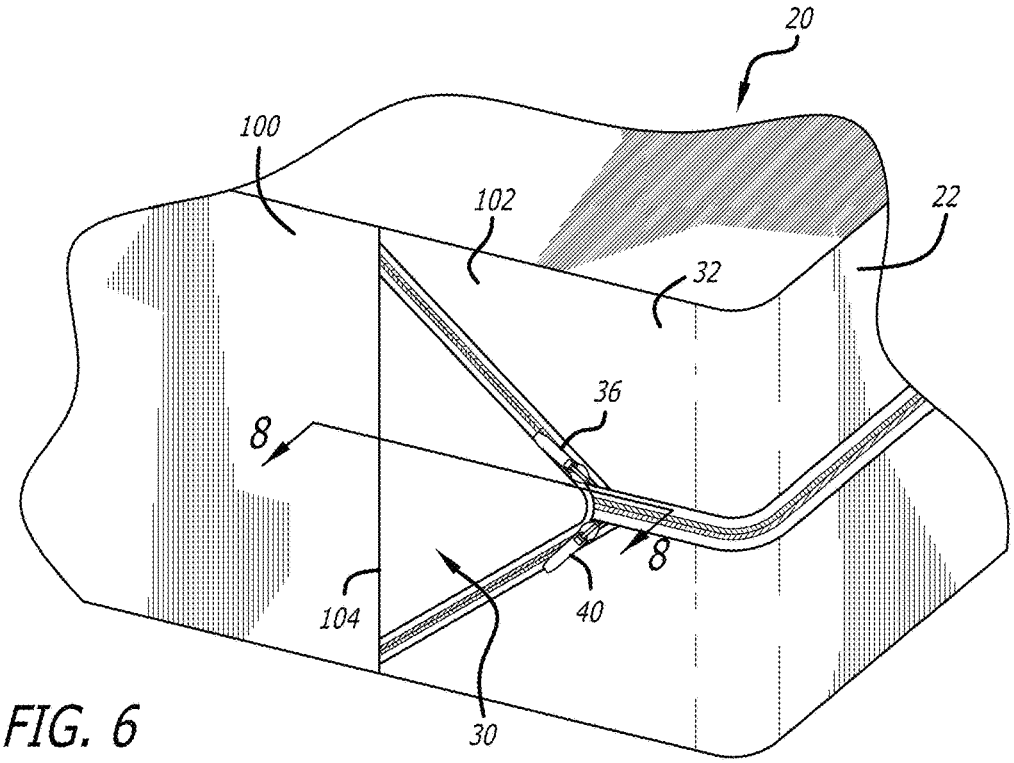
FIG. 6 is a view of the corner portion shown in FIG. 5, with the flap shown in a closed and zipped condition.

FIGS. 5-6 show the flap 30 folded completely onto the vertical side 32 of the encasement 22. In this position, the flap 30 completely covers the distal end portion of the primary zipper 24 with the zipper folded over onto itself. The distal-most portion of the zipper 24 including the end stop 35 are inverted, disposed on the underside of the flap 30 and covered by the flap. To secure the flap in this position, the secondary zippers 38 and 42 are closed by moving their respective sliders 36 and 42 along the zipper teeth to mesh the teeth together, as shown in FIG. 6. Preferably, the sliders are disposed near the base of the flap 30 when the secondary zippers 38 and 42 are open, and disposed near the top of the flap 30 when the secondary zippers are closed. The zippers 38 and 42 provide a secure closure for the flap which will not degrade or wear out through washing or normal usage of the cover 22, and will remain operational even if lint or dust particles accumulate on the mattress cover and zipper.

Figure 7:
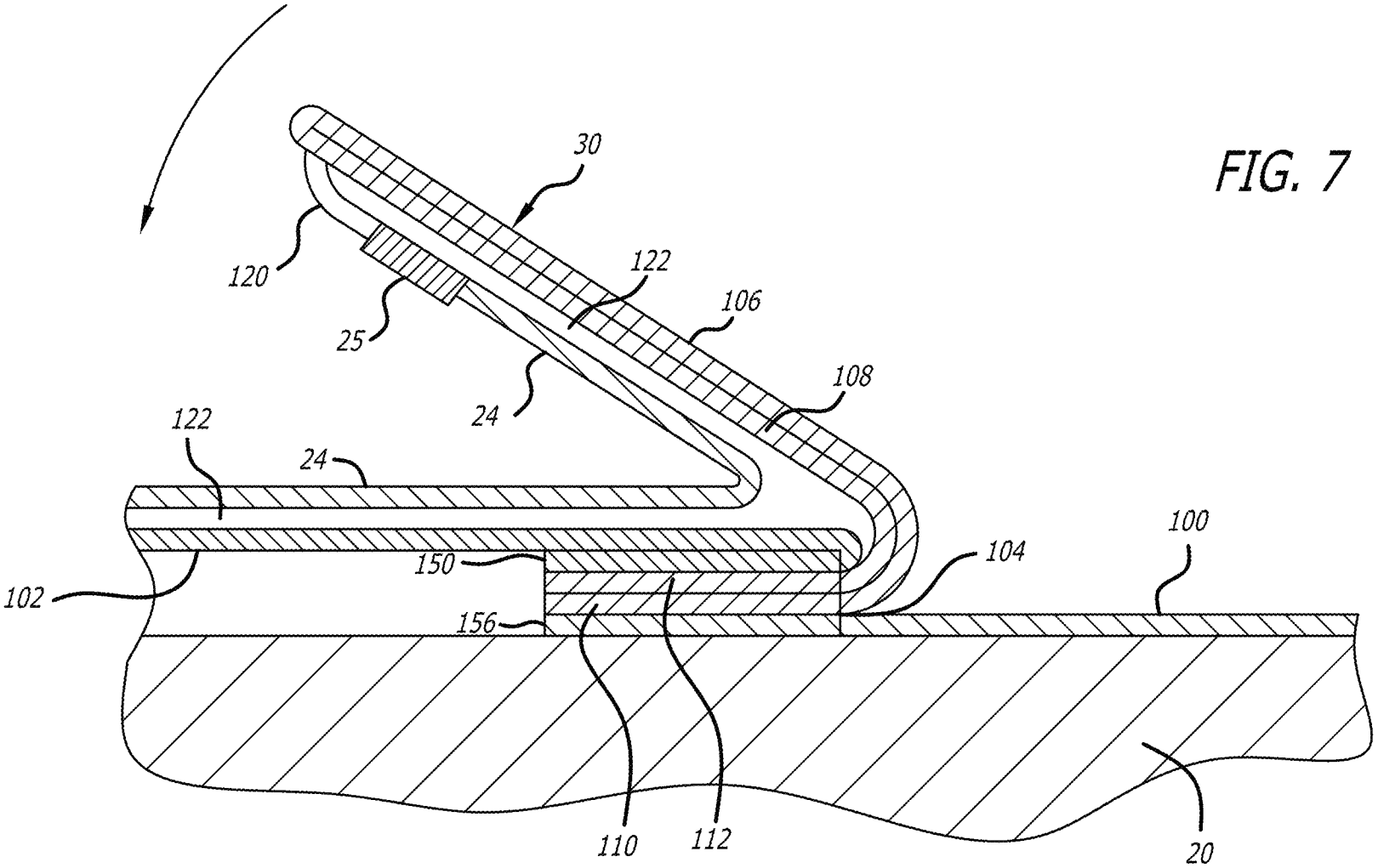
FIG. 7 is an enlarged, fragmentary, sectional view taken substantially along the line indicated as 7-7 in FIG. 4.
Figure 8:
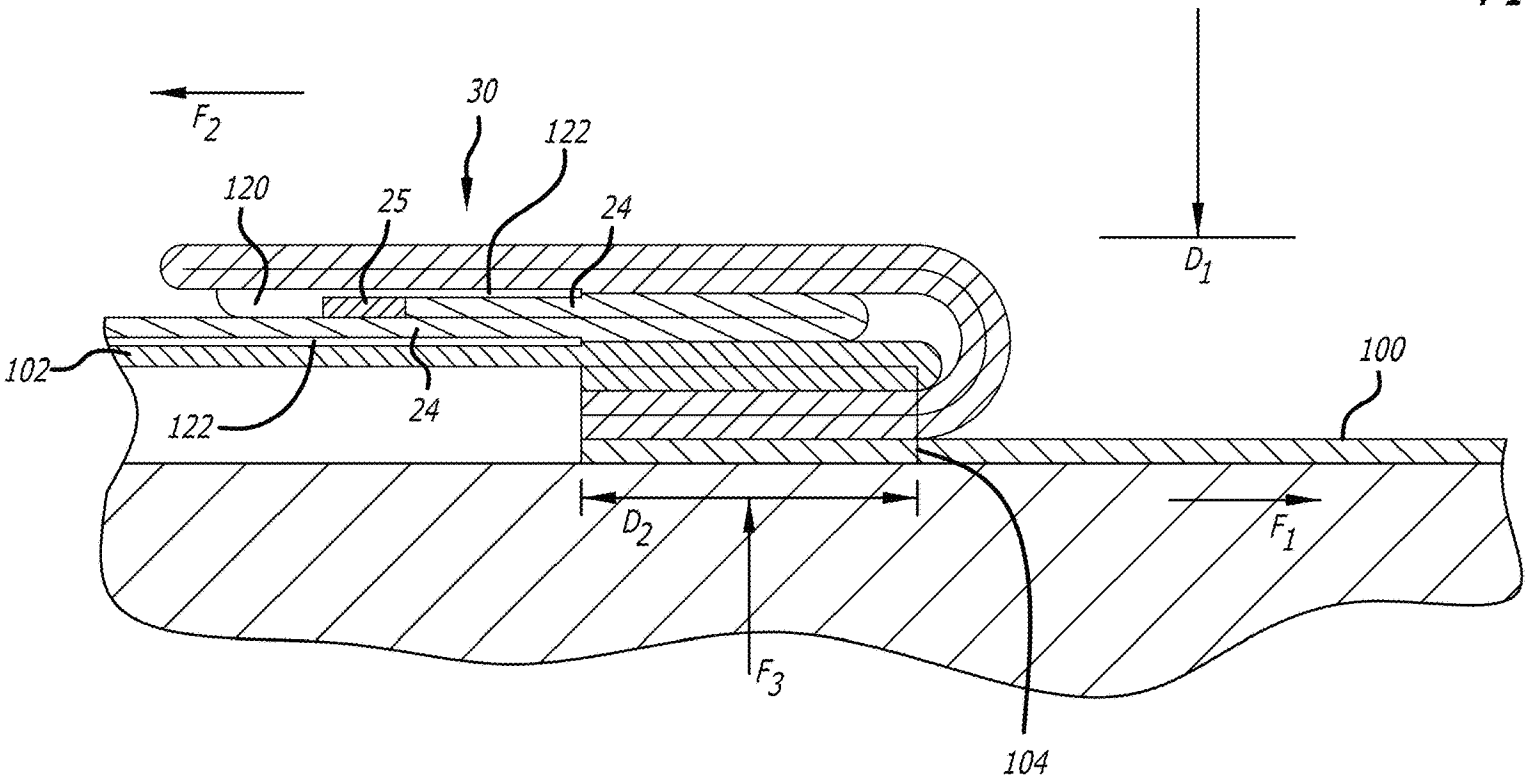
FIG. 8 is an enlarged, fragmentary, sectional view taken substantially along the line indicated as 8-8 in FIG. 6.

FIG. 7 is a fragmentary sectional view, taken through the flap 30, mattress cover 22 and mattress 20, substantially along the plane defined by the line 7-7 in FIG. 4, with the flap in a partially folded position. FIG. 8 is a sectional view, taken in the same plane when the flap has been completely folded, closed and secured, as shown in FIG. 6.

As best shown in FIG. 6, the vertical side wall 32 of the encasement 22 is preferably formed from two separate sheets, namely a left sheet 100 and a right sheet 102, that are joined at the location of the flap 30. The left sheet has a distal end 156. The right sheet has a distal end 150. (FIG. 7)

The connection between the sheets is best shown in FIGS. 7 and 8, although the sheets have been inverted left to right because of the particular view being illustrated. A seam 104 in the form of stitching connects the left sheet 100 to the right sheet 102. In addition to the left sheet 100 and the right sheet 102, the flap 30 is shown in relation to these sheets. The flap 30 can be formed one or more layers of material, but preferably comprises a double layered sheet, with outer layer 106 and inner layer 108. The distal ends 110, 112 of those layers are inserted between distal ends 150, 156 of the left sheet 102 and right sheet 100. All four distal ends 110, 112, 150 and 156 are overlapping and stitched together with the same stitched seam 104. The overlapping stitched ends 110, 112, 150 and 156 are then preferably folded back under the right sheet 102 along the path of the primary zipper 24, as shown in FIG. 7.

As previously noted, the primary zipper 24 is disposed on the inner layer 108 of the flap 30. The teeth 24', 24" of the primary zipper 24 are attached to the flap 30 and to the cover 22 with conventional zipper tapes 124 (as best seen in FIG. 4). The tapes 124 are stitched to the flap 30 with a stitched seam that passes through the inner 108 and outer 106 layers of the flap 30, leaving a space 122 between the zipper teeth and the inner sheet 108 when the zipper is closed the space is potentially large enough for bed bugs to travel along. As previously noted, even when the slider 25 is moved to its most distal position, as seen in FIGS. 7 and 8, it may leave an opening or gap 120 near the end stop. This opening 120, combined with the elongate space 122, creates a potential passageway for bed bugs to travel along and enter the mattress should the bugs succeed in getting under the flap 30.

In a preferred embodiment, the seam 104 that stitches together the left sheet 100, right sheet 102, outer layer 106 and inner layer 108, produces a localized bulge of significant depth D1 where the seam is located, as shown in FIG. 8. It will be appreciated that, when the secondary zippers 38 and 42 are closed, tension forces are developed in the vertical side 32 and flap 30 comprising a force F1 pulling one way and a force F2 pulling in an opposite direction, as shown in FIG. 8. In equilibrium, F1 will equal F2. Now, due to the bulge depth D1, a balancing force F3 will be set up which is exerted by and against the mattress 20, along which the left sheet 100 and right sheet 102 extend. The force F3 has the effect of closing the space 122 where it loops around the bend near the stitched seam 104. It will be appreciated that the force F3 is proportional to the forces F1 and F2, so that increasing F1 and F2 will increase F3. In order to provide a constant and high level of force F1 and F2, it has been found desirable to arrange the secondary zippers 38 and 42 to extend at an angle (shown as angle A in FIG. 3) of between 30 degrees and 60 degrees to the horizontal (as defined by the path of the primary zipper 24). This angle has the result that, when the secondary zippers 38 and 42 are closed (FIG. 6) the tension in the fabric of the flap 30 and vertical side 32 are enhanced, thereby increasing the forces F1 and F2. This configuration provides a highly advantageous arrangement, so that despite a possible opening 120 at the distal end of the primary zipper 24, the spaces that remain for ingress of bed bugs into the encasement past the stitched seam 104 are effectively eliminated.

Thus, there is provided a system for sealing off a mattress to prevent the movement and survival of bed bugs in a mattress. The present invention may, of course, be carried out in other specific ways than those herein set forth without departing from the essential characteristics of the invention. The present embodiments are, therefore, to be considered in all respects as illustrative and not restrictive, while the scope of the invention is set forth in the claims that follow.

We claim:

1. A bed bug protective encasement for a mattress comprising:

a cover having an elongated opening with a first end and a second end formed therein, the elongated opening being adaptable to receive the mattress within the cover;

a primary zipper disposed along the elongated opening and having a slider movable from the first end to the second end to close the elongated opening;

a flap attached to the cover adjacent the second end of the elongated opening and being foldable over the second end of the elongated opening, the primary zipper extending onto the flap and terminating near a distal end of the flap;

a secondary zipper system, comprising a first zipper attached to a side of the flap, and a second zipper attached to an opposite side of the flap to secure the flap when the flap is folded over the second end of the elongated opening; and wherein, the first zipper extends at an angle between 30 degrees and 60 degrees above a longitudinal axis of the primary zipper, and the second zipper extends at an angle between 30 degrees and 60 degrees below the longitudinal axis of the primary zipper.

2. The bed bug protective encasement of claim 1, wherein the flap has a triangular shape.

3. The bed bug protective encasement of claim 1, wherein:

the cover comprises a vertical sidewall formed by a left sheet and a right sheet, the left sheet having a first distal end, and the right sheet having a second distal end, the first distal end overlapping the second distal end for a certain distance;

the flap comprises at least one layer, the at least one layer having a third distal end;

wherein the third distal end is positioned between the first distal end and the second end, and wherein the first distal end, the second distal end, and the third distal end are all stitched together by a seam and disposed between the vertical sidewall and the mattress folded back under the flap along the path of the primary zipper.

* * * * *